US006097276A

United States Patent [19]

Van Den Broek et al.

[11] Patent Number: 6,097,276

[45] Date of Patent: Aug. 1, 2000

[54] ELECTRIC RESISTOR HAVING POSITIVE AND NEGATIVE TCR PORTIONS

[75] Inventors: Jan J. Van Den Broek; Anton Heger, both of Eindhoven, Netherlands

[73] Assignee: U.S. Philips Corporation, New York, N.Y.

[21] Appl. No.: 08/353,040

[22] Filed: Dec. 9, 1994

[30] Foreign Application Priority Data

Dec. 10, 1993 [BE] Belgium ..... 09301372

[51] Int. Cl.[7] ..... H01C 7/06

[52] U.S. Cl. ..... 338/9; 338/22 R; 338/320; 338/308; 338/309

[58] Field of Search ..... 338/22 R, 225 D, 338/260, 295, 319–320, 306, 308, 309, 7, 9

[56] References Cited

U.S. PATENT DOCUMENTS

| | | | |
|---|---|---|---|
| 2,050,703 | 8/1936 | Johnson | 338/9 |
| 3,577,209 | 5/1971 | Perkins | 254/223 |
| 4,079,349 | 3/1978 | Dorfeld | 338/9 |
| 4,104,607 | 8/1978 | Jones | 338/309 |
| 4,413,170 | 11/1983 | Val et al. | 338/22 R |
| 4,746,896 | 5/1988 | McQuaid et al. | 338/308 |
| 4,791,276 | 12/1988 | Midgley et al. | 338/22 R |
| 4,907,341 | 3/1990 | Chapel et al. | 29/612 |
| 5,039,976 | 8/1991 | Drabkin | 338/314 |
| 5,088,329 | 2/1992 | Sahagen | 73/727 |
| 5,448,103 | 9/1995 | de Wit | 338/22 SD |

OTHER PUBLICATIONS

Dummer, "Materials For Conductive and Resistive Functions", pp. 16–17 (ed. by A. Javitz, 1970).

*Primary Examiner*—Karl Easthom
*Attorney, Agent, or Firm*—Steven R. Biren

[57] ABSTRACT

A description is given of a precision resistor. The resistor comprises a substrate having two connections which are electrically interconnected via a resistance path, said resistance path comprising a first path portion having a positive TCR and a second path portion having a negative TCR. The resistor is characterized in that the resistance material of both path portions is selected so that the resistance values and the absolute TCRs of both path portions are comparable and in that both path portions are trimmed so that the resistor has desired resistance and TCR values. Preferably, the resistance materials used for the path portions consist of an alloy of substantially the same composition on the basis of CuNi or NiCrAl. The invention makes it possible to very accurately and reproducibly mass-produce precision resistors.

5 Claims, 4 Drawing Sheets

ELECTRIC RESISTOR HAVING POSITIVE AND NEGATIVE TCR PORTIONS

BACKGROUND OF THE INVENTION

The invention relates to a resistor which comprises a substrate having two connections which are electrically interconnected via a resistance path, said resistance path comprising a first path portion having a positive TCR (temperature coefficient of resistance) and a second portion having a negative TCR.

Resistors of the type mentioned above are referred to as "precision resistors". They must have an accurately adjustable and readily reproducible resistance value. The TCR of such a precision resistor must also be accurately adjustable and readily reproducible. The deviation of the resistance value is preferably below 0.1%, and the deviation of the intended TCR is preferably below 1 ppm/° C. The TCR of a resistor is to be understood to mean the relative change of the resistance as a function of temperature. The TCR is generally given in ppm/° C. In general, the aim is to manufacture precision resistors whose TCR is substantially zero.

A resistor of the type mentioned in the opening paragraph is known per se. For example, in U.S. Pat. No. 4,907,341, a description is given of a compound resistor of this construction. In this case, the resistance paths of the individual resistors are composed of a first path portion, which is referred to as "adjustable portion" and a second path portion which is referred to as "resistance portion". The adjustable portion consists of an electrically well-conducting material having a relatively high, positive TCR. The resistance portion consists of a customary resistance material having a relatively low, negative TCR. In a typical exemplary embodiment of said Patent Specification, NiCr having a TCR in the range from −30 to 0 ppm/° C. is used as the material for the resistance portion, while Ni having a TCR of +5000 ppm/° C. is used as the material for the adjustable portion. The difference in resistance between both portions amounts to a factor of 1000.

In the manufacture of the known type of resistors the resistance value and the TCR are adjusted as follows. First, the resistance of the individual resistors is brought to the desired value by etching away the first path portion of resistance material. Subsequently, the TCR of the individual resistors is reduced to a value close to 0 ppm/° C. by subjecting the second path portion of the conductive material to an operation which is also referred to as "trimming".

The manufacture of the known resistor has several disadvantages. For example, it has been found in practice that the TCR of untrimmed resistors can vary quite substantially as a result of small variations in the composition of the resistance material. As a result, a substantial portion of the mass-produced resistors already have a positive TCR before they can be subjected to the trimming process. Under these conditions, the TCR of these resistors can no longer be reduced to a value close to zero. The reason for this being that trimming of the adjustable portion leads to a further increase of the (positive) TCR. Due to this disadvantage, a considerable number of the resistors manufactured must be rejected. Moreover, adjusting of the TCR causes the accurately adjusted resistance value to change.

SUMMARY OF THE INVENTION

It is an object of the invention to overcome the above disadvantages. The invention more particularly aims at providing resistors whose TCR can both be increased and reduced during the trimming process.

These and other objects of the invention are achieved by a resistor of the type mentioned in the opening paragraph, which is characterized according to the invention in that the resistance material of both path portions is selected so that the resistance values and the absolute TCRs of both path portions are comparable and in that both path portions are trimmed so that the resistor has a desired resistance value and a desired TCR.

In the manufacture of the resistor in accordance with the invention, both the first and the second path portion are used as adjustable portions. By virtue thereof, the TCR of the resistor can be reduced or increased by carrying out the trimming process in the path portion having, respectively, a positive or a negative TCR. In the trimming process in accordance with the inventive method, the TCR and the resistance value of the resistor are adapted simultaneously. By virtue of this measure, the problem of rejects encountered in the manufacture of the known resistor is solved completely. Moreover, by means of the inventive method, in principle, both the resistance value and the TCR of the resistor can be changed to a desired value in a single trimming step. The choice of resistance materials for both path portions having comparable resistance values and TCRs has an additional important advantage. This measure enables the resistance values and absolute values of and the TCR of the total resistance path to be adjusted more accurately in the inventive resistor than in the state-of-the-art resistor.

It is noted that the expressions "comparable resistance values" and "comparable TCRs" is to be understood to mean that the difference in resistance values and (absolute) TCRs between both path portions is maximally a factor of 10. It has been found that at larger differences it becomes much more difficult to accurately adjust the resistance value and the TCR of the resistor. The difference between said values is preferably less than a factor of 5. The accuracy of adjustment is optimal if the difference between said values is less than a factor of 2.

In the resistor in accordance with the invention, different types of substrates can be used, such as cylindrical substrates. Preferably, however, flat substrates are used in which the electrical connections are provided at two oppositely located ends of the substrates. Such resistors in the form of leadless or SMD resistors can be soldered onto a so-called printed circuit board (PCB). However, the invention method can alternatively be used with components having leads. For the substrate material, in principle, use can be made of any electrically insulating material. Preferably, however, use is made of substrates of a sintered inorganic material, a particularly suitable representative of which is aluminium oxide.

The electrical connections and the path portions of the resistance layer can be customarily provided on the substrate by means of vacuum deposition or sputtering techniques in combination with lithographic methods. For the material of the connections use can be made of electrically well-conducting metals. In this respect, in particular Cu and Au proved to be very suitable. These metallic connections can be thickened in a further operation, for example by means of electroplating.

The path portions in a resistor in accordance with the invention may have different configurations. For example, the path portions may be provided next to each other on the substrate so that both portions electrically contact the two connections at two oppositely located ends. In this embodiment of the method in accordance with the invention, the adjustment of the final resistance and TCR values must take place via an iterative process in which the resistance and TCR values of the total resistor path are monitored simultaneously.

In accordance with an alternative embodiment the path portions are not juxtaposed but coaxial. In this embodiment, a resistance layer electrically contacts both connections, while a second resistance layer contacts one of said connections and a certain length of said layer extends entirely on or underneath the first resistance layer. In this embodiment the first path portion consists of a single resistance layer and the second path portion consists of a double resistance layer.

A preferred embodiment of the resistor in accordance with the invention is characterized in that one of the connections is electrically connected to only one of the path portions, and in that the other connection is electrically connected only to the other path portion and in that both path portions are electrically interconnected via a third connection. In this configuration of the inventive resistor, both path portions are not juxtaposed but coaxial. It is noted that also in this embodiment, a path portion may be composed of two or more layers. However, single-layer path portions are preferred.

Said preferred embodiment has the important advantage that by virtue of the presence of a third connection the resistance value and the TCR of the path portions can be measured, both separately and in series, during trimming of the resistor. By measuring these values at at least two different temperatures, it can be determined by means of a simple (computer) calculation to which extent both path portions must be trimmed. By virtue thereof, the desired resistance and TCR values can be given to the resistor in a single automated trimming operation.

The path portions can be made from various resistance alloys. An embodiment of the resistor in accordance with the invention which is suitable in this respect is characterized in that the resistance material of both path portions consists of an alloy of substantially the same elemental composition this alloy having the general formula CuNi or NiCrAl. These alloys consist of the same chemical elements but the compositions differ slightly. The quantities of the constituent elements of the alloys for both path portions differ less than 25 at. %. The choice of such alloys has various important advantages. Since there is only a slight difference in composition between both alloys, the bonding strength of both sub-layers to a certain substrate is comparable. Further, the resistance value of both alloys also is substantially equal. As a result of small differences in the composition of certain types of CuNi and NiCrAl alloys, however, one alloy may have a positive TCR and the other alloy may have a negative TCR. The above-mentioned alloys may optionally also contain small quantities of other elements.

It is noted that the same resistance material may alternatively be used for both path portions. Specific material choices make it possible to obtain path portions of comparable TCR but of opposite sign, by subjecting the path portions provided on the substrate to thermal treatments at different temperatures. In practice, this is carried out by providing a first path portion on the substrate and subjecting the substrate and said path portion to a first thermal treatment, whereafter the second path portion is provided on the substrate and, finally, the substrate and the two path portions are subjected to a second thermal treatment. Said second thermal treatment is carried out at a much lower temperature than the first thermal treatment. Such thermal treatments have no noticeable influence on the resistance value, so that said value is substantially identical for both path portions.

Yet another embodiment of the resistor in accordance with the invention is characterized in that CuNi is used as the resistance material of both path portions, and in that a bonding layer formed of TiW or NiCr(Al) is provided between the substrate and the path portions. The thickness of said layer is preferably less than 100 nanometer. By virtue of said bonding layer a very good adhesion of the resistance path to the substrate is obtained.

DETAILED DESCRIPTION OF THE INVENTION

Figure 1A:
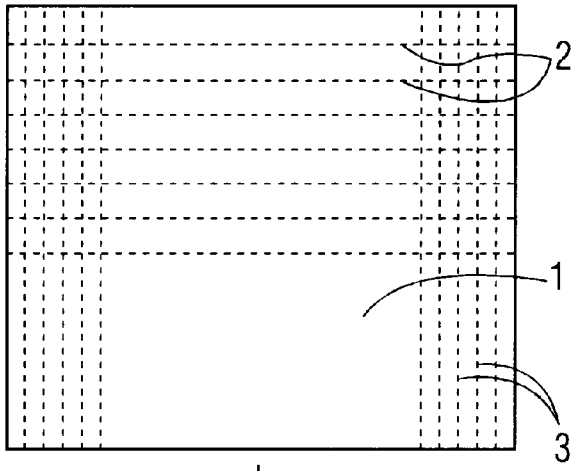
FIG. 1 diagrammatically shows a number of steps of a method of manufacturing the resistor in accordance with the invention
Figure 1B:
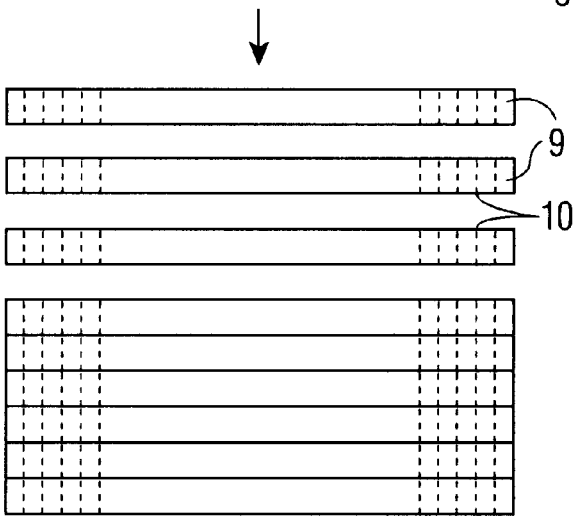
Figure 1C:
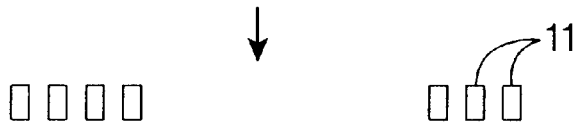
Figure 1D:
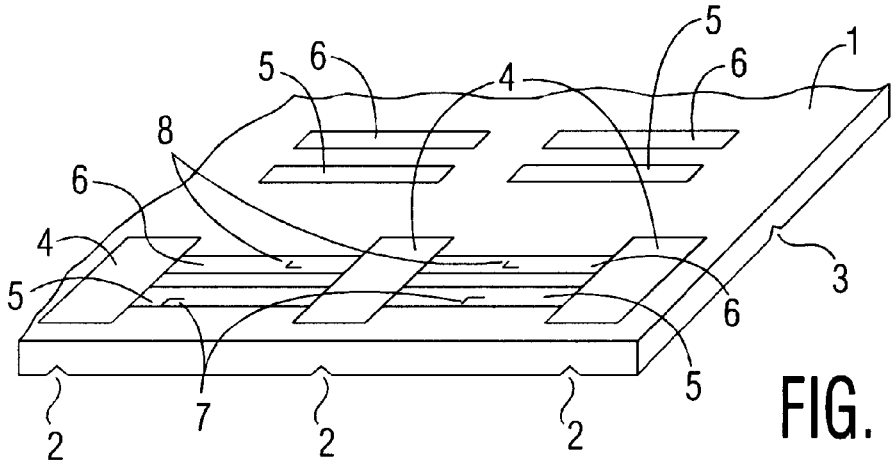

The invention will now be described in greater detail with reference to the exemplary embodiments and the accompanying drawing;

It is noted that the (parts of the) resistors are not drawn to scale.

The manufacture of resistors in accordance with the invention is described with reference to FIG. 1. In said Figure, use is made of a flat substrate plate 1 of sintered aluminium oxide having dimensions of 110×80×0.5 mm, as shown in a plan view in FIG. 1-A. The bottom side of this substrate plate is provided with a first number of parallel, V-shaped grooves of fracture 2 (the bar grooves) and a second number of parallel, V-shaped grooves of fracture 3 (the chip grooves). The chip grooves and the bar grooves have a depth of approximately 0.1 mm and extend perpendicularly to each other. For clarity, only a few grooves are indicated by dotted lines in the Figure.

As shown in greater detail in FIG. 1-D, the top side of the substrate plate is first provided, in separate steps, with path portions 5 and 6 by means of lithographic techniques. For the resistance material of the two path portions use is made of alloys of substantially identical composition on the basis of CuNi, i.e. $Cu_{55}Ni_{45}$ (layer thickness 110 nm) and $Cu_{68}Ni_{32}$ (layer thickness 100 nm). The resistance value of said alloys is substantially equal. However, one alloy has a positive TCR, whereas the other alloy has a negative TCR. Subsequently, first and second connections 4 of sputtered Cu are provided in a thickness of 5 micrometers. Said connections are also provided by means of lithographic techniques. The substrate plate is subsequently exposed to a temperature treatment at 350° C. to stabilize different properties of the resistors.

Subsequently, in the plate phase, the R-value of the individual resistors under manufacture is determined at two different temperatures. The TCR of each resistor is calculated from the results of said measurements. Subsequently, the intended resistance value and the intended TCR of each resistor are adjusted by means of an iterative trimming process. In this trimming process, traces 7 and 8 are formed in the path portions 5 and 6.

After the trimming process, which is preferably carried out by means of a laser, the substrate plate is severed along the grooves of fracture 2 to form bars 9, as diagrammatically shown in FIG. 1-B. Subsequently, the fracture faces 10 of the bars are provided with a Ni layer in an electroless process, after which said layer is thickened by electroplating. If desired, a solder layer is applied to said Ni layer. The end contacts have now been formed. They electrically contact the connections 4. Finally, the bars are severed along the grooves of fracture 3 to form individual resistors 11, as diagrammatically shown in FIG. 1-C. A total number of approximately 1800 resistors having dimensions of 1.5×3.0×0.5 mm can be obtained from said substrate.

It is noted that the resistor may optionally be provided with a bonding layer which is present between the substrate and the resistance path. Said bonding layer must be applied to the substrate before the path portions are provided. In the above-mentioned exemplary embodiment, a 30 nm thick layer of an alloy comprising predominantly Ti and W (TiW) was used for this purpose. If necessary, third connections can be sputtered on to the substrate at the same time as the other connections. It is also possible to provide the resistors with a protective coating, for example a lacquer, after the trimming process.

Figure 2:
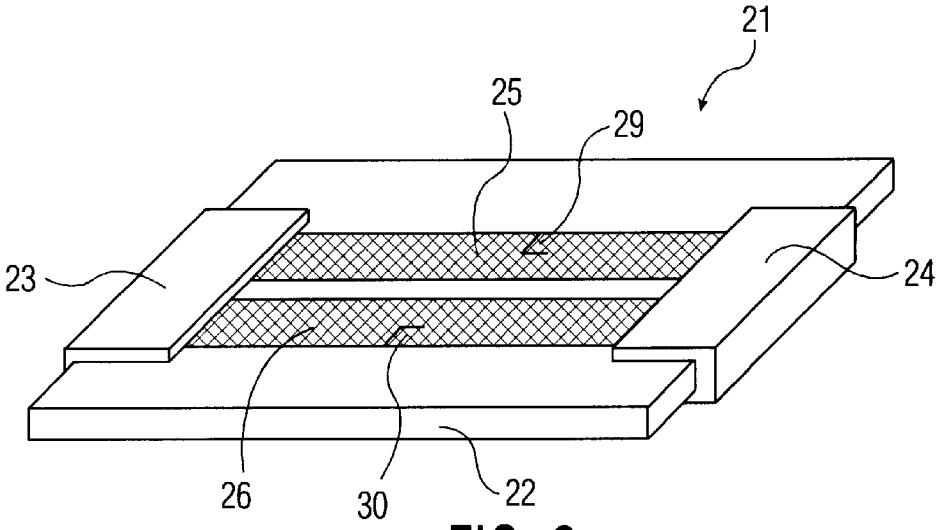
FIG. 2 is a first embodiment of a resistor in accordance with the invention
Figure 4A:
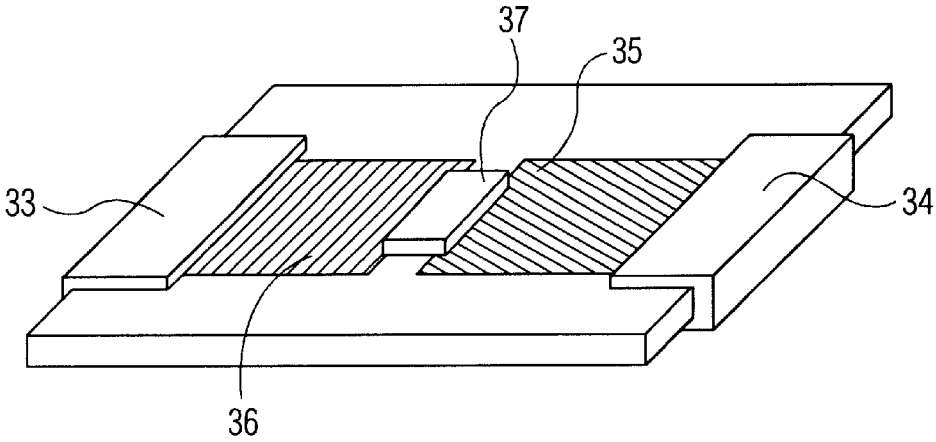
FIG. 4 shows a further preferred embodiment of a resistor in accordance with the invention FIG. 5 graphically shows the resistance (R) as a function of the temperature (T) of a resistor in accordance with the invention.
Figure 4B:
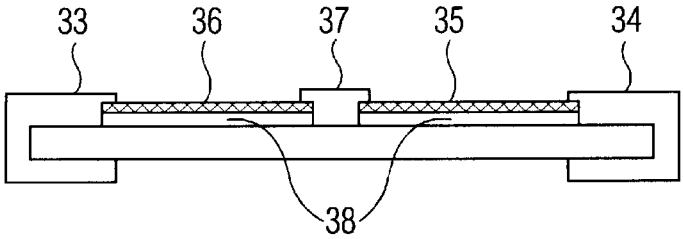
Figure 3A:
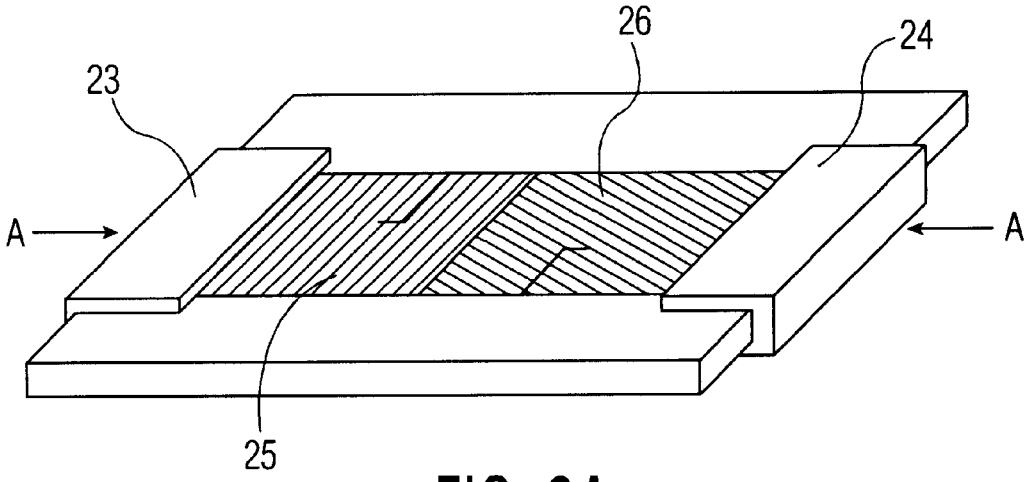
FIG. 3 is a preferred embodiment of a resistor in accordance with the invention
Figure 3B:
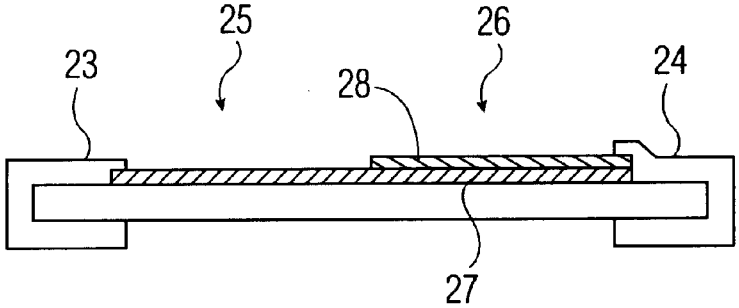
Figure 3C:
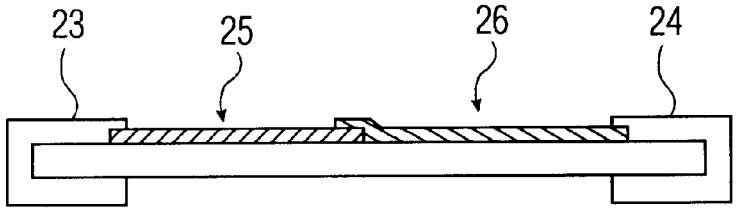

FIGS. 2, 3 and 4 show different embodiments of resistors in accordance with the present invention. In these embodiments attention is paid in particular to the different configurations of the first and second path portions. Resistors having said configurations can be manufactured by means of the method described above by changing the layout of the masks used in the lithographic steps.

FIG. 2 is an elevational view of a resistor 21 which comprises an aluminium oxide substrate 22 a main surface of which is provided with two connections 23 and 24 as well as a resistance path. Said resistance path is composed of two path portions 25 and 26 which are arranged on the substrate in a side-by-side relationship so that both path portions electrically contact the connections 23 and 24. The resistance material of path portions 25 and 26 consists of an alloy on the basis of NiCrAl. Path portion 25 comprises 33.6 at. % Ni, 55.4 at. % Cr and 11.0 at. % Al. Path portion 26 comprises 30.0 at. % Ni, 60 at. % Cr and 10.0 at. % Al. Said compositions correspond to a sheet resistance of 50.5 Ohm/□ (path portion 25) and 58.5 Ohm/□ (path portion 26). The TCRs of said compositions are −33 ppm/° C. (path portion 25) and +45 ppm/° C. (path portion 26). These values were obtained after the resistor had been exposed to a temperature treatment at 350° C. for 1 hour. By iterative trimming of the path portions, the TCR of the total resistor path could be brought to 0.9 ppm/° C. In this trimming process, traces 29 and 30 were formed.

FIG. 3-A is an elevational view of an alternative embodiment of the resistor manufactured in accordance with the method of the invention. FIGS. 3-B and 3-C are cross-sectional views of two variations of said embodiment, taken on the line A—A of FIG. 3-A.

In the resistor shown in FIG. 3-B the path portions 25 and 26 do not run from connection 23 to connection 24, but are coaxially arranged. Path portion 25 consists of a single layer of $Cu_{60}Ni_{40}$, having a square resistance of 5.1 Ohm and a TCR of −80 ppm/° C. Path portion 26 is composed of a double layer consisting of a bottom layer 27 and a top layer 28. The bottom layer 27 consists of the same resistance material as path portion 25. The top layer has the composition $Cr_{60}Ni_{30}Al_{10}$ with a square resistance of 10.1 Ohm. After a temperature treatment at a relatively high temperature, the TCR of this layer was 400 ppm/° C. The square resistance of the path portion 26 is 12.2 Ohm. The TCR of this compound layer is +82 ppm/° C. In the final trimming process the TCR of the resistance path could be brought to a value below 1 ppm/° C. In this trimming process, traces 29 and 30, as shown in FIG. 3-A, were formed.

FIG. 3-C is a cross-sectional view of a different embodiment of the resistor represented in elevation in FIG. 3-A. In this particular embodiment, use is made of path portions 25 and 26 which consist of a single layer and which partly overlap. The alloy $Cr_{55}Ni_{34}Al_{11}$ is used as the resistance material for both path portions. This resistance material has a square resistance of 138.3 Ohm. The TCR of path portion 25 is +80 ppm/° C. The TCR of path portion 26 is −55 ppm/° C. The difference in TCR values was obtained by subjecting path portion 25 to an additional temperature treatment at 460° C., before path portion 26 was provided on the substrate. In the final trimming process, the TCR of the resistance path could be brought to a value below 1 ppm/° C. In this trimming process, traces 29 and 30, as shown in FIG. 3-A, were formed.

FIG. 4 shows a preferred embodiment of the resistor in accordance with the invention. FIG. 4-B is a cross-sectional view of the resistor shown in an elevational view in FIG. 4-A. In this embodiment, both connections 33 and 34 are electrically connected to only one of the two path portions 35 and 36. Said path portions are electrically connected to a third connection 37. In this configuration, the path portions are more or less coaxially arranged. The presence of the third connection makes it possible to measure the resistance and TCR values of both path portions of this resistor simultaneously. By virtue thereof, a single measurement, carried out at two different temperatures, suffices to calculate a trimming procedure which provides the resistor with desired resistance and TCR values.

The resistance material for both path portions is based on CuNi. For path 35 use is made of $Cu_{64}Ni_{36}$ having a TCR of −32 ppm/° C. and a resistance of 34.36 Ohm. For path 36 use is made of $Cu_{70}Ni_{30}$ having a TCR of +52 ppm/° C. and a resistance of 31.40 Ohm. The resistance of the entire resistance path is 65.76 Ohm. The TCR of the resistor is 8 ppm/° C. Layer 38 is a bonding layer of TiW which provides a satisfactory adhesion between the resistance path and the substrate.

Figure 5:
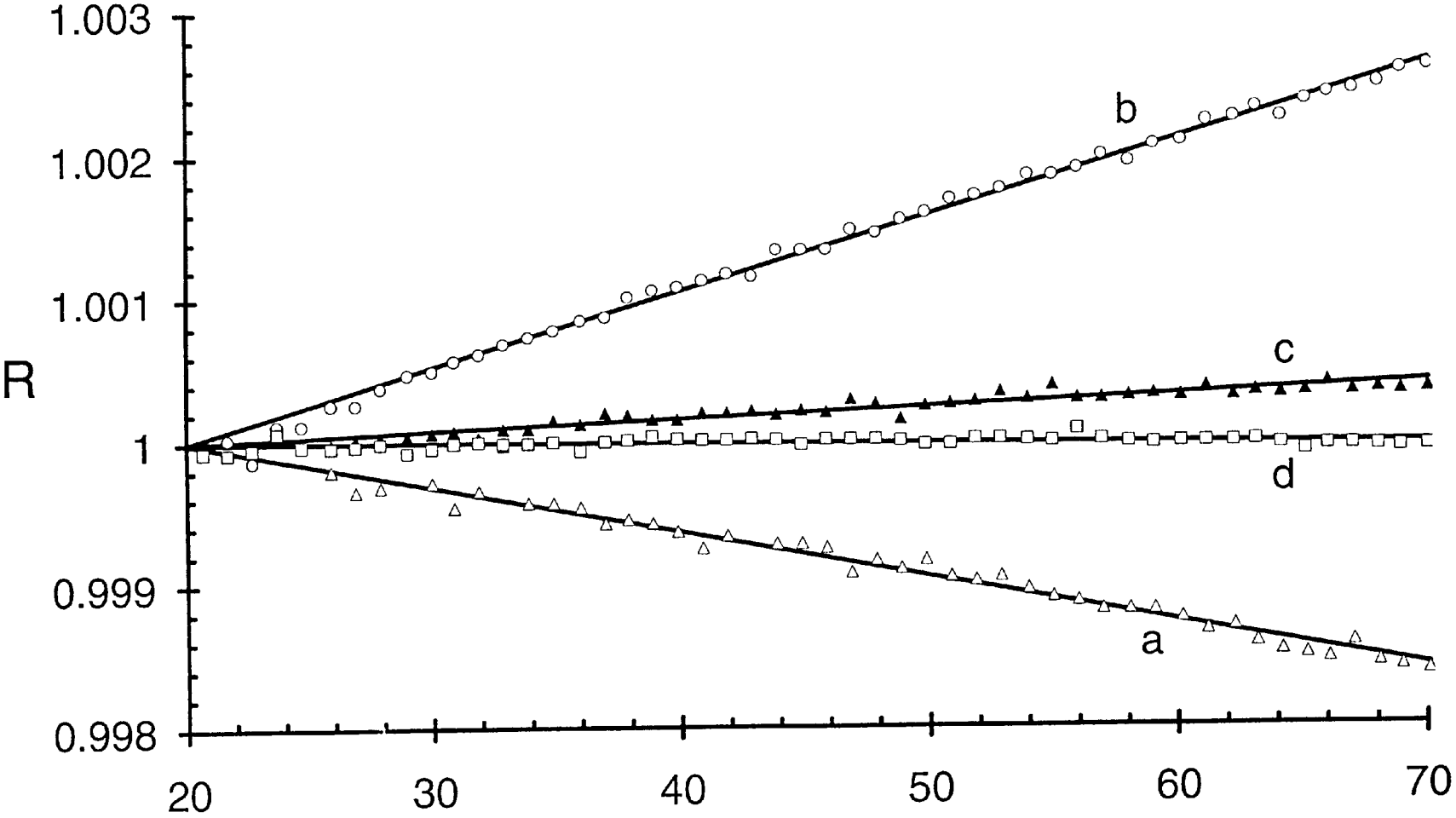

FIG. 5 shows a graph in which the variation of the resistance R (normalized) is plotted as a function of the temperature T (° C.) of the resistor shown in FIG. 4. The lines a and b correspond to the variation of the resistance value of the path portions 35 and 36 before the trimming process. Line c shows the variation of the resistance value of the entire resistance path before the trimming process. As stated above, the TCR of the untrimmed resistor is 8 ppm/° C. After a first trimming treatment of path 36 the TCR is 1.5 ppm/° C. (line c). After a second trimming treatment the TCR is below 1 ppm/° C. (line d).

What is claimed is:

1. A resistor comprising an electrically insulating substrate having two connections which are electrically interconnected by means of a resistance path, said resistance path comprising a first resistance alloy portion with a positive TRC and a second resistance alloy portion with a negative TRC, and wherein the difference in the resistance values between first and second alloy portions is maximally a factor of 10 and the difference in the absolute values of the TRC between first and second alloy portions is maximally a factor of 10, the first and second portions both being trimmed so that the resistor has a desired resistance value and a desired TRC.

2. A resistor as claimed in claim 1, characterized in that one of the connections is electrically connected to only one of the path portions and in that the other connection is electrically connected only to the other path portion and in that both path portions are electrically interconnected via a third connection.

3. A resistor as claimed in claim 2 wherein the resistance material of both path portions consists of an alloy of substantially the same composition and selected from the group consisting of CuNi and NiCrAl.

4. A resistor as claimed in claim 1 characterized in that the resistance material of both path portions consists of an alloy of substantially the same composition selected from the group consisting of CuNi and NiCrAl.

5. A resistor as claimed in claim 4, characterized in that CuNi is used as the resistance material of both path portions, and in that a bonding layer selected from the group consisting of TiW and NiCrAl is situated between the substrate and the path portions.

* * * * *